United States Patent [19]

Paramore, Jr.

[11] Patent Number: 4,704,812

[45] Date of Patent: Nov. 10, 1987

[54] SCRAPER PAN WITH CUTTING BLADE

[76] Inventor: Alvie R. Paramore, Jr., Rte. 3, Box 433, Ozark, Ala. 36360

[21] Appl. No.: 887,896

[22] Filed: Jul. 22, 1986

[51] Int. Cl.[4] ..... E02F 3/40

[52] U.S. Cl. ..... 37/141 R; 299/85

[58] Field of Search ..... 37/141 R, 141 T, DIG. 18; 56/17.4, 17.6; 299/37–38, 85

[56] References Cited

U.S. PATENT DOCUMENTS 3,889,405 6/1975 Ranini ..... 37/141 R

FOREIGN PATENT DOCUMENTS 1291227 10/1972 United Kingdom ..... 37/141 R
994633 2/1983 U.S.S.R. ..... 37/141 R
1112095 9/1984 U.S.S.R. ..... 37/141 R

*Primary Examiner*—E. H. Eickholt
*Attorney, Agent, or Firm*—Peter L. Klempay

[57] ABSTRACT

A blade assembly for the cutting edge of a scraper pan type earth mover includes a fixed blade having forward and downwardly projecting cutting teeth and a moveable blade also having cutting teeth, the moveable blade overlying the fixed blade, and power means for reciprocating the moveable blade in a transverse direction.

5 Claims, 9 Drawing Figures

FIG. 1
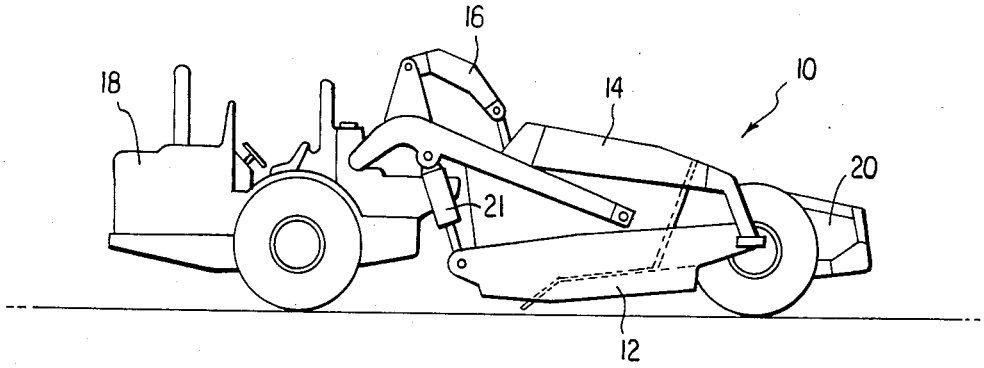
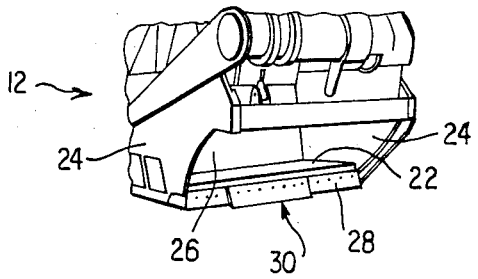
FIG. 2

SCRAPER PAN WITH CUTTING BLADE

The present invention pertains to excavating equipment with a scraper pan for digging and loading dirt and, more particularly, to cutting blade arrangements for such equipment.

BACKGROUND OF THE INVENTION

In the use of scraper pan excavators or earth movers, it is frequently necessary to employ a second machine to supply sufficient power to assist in propelling the earth mover which loading is due to the force required to cut the earth with the scraper pan blade. Various arrangements of oscillating or vibrating blades and blade teeth have been proposed to facilitate such cutting and thereby reduce the overall power requirements. Examples of such arrangements are found in U.S. Pat. Nos. 2,443,492, Austin; 2,619,748, McIntosh; 3,475,841, Delfino et al; 3,628,265, Galis; and 3,889,405, Ranini.

It is the primary object of the present invention to provide a cutting blade for a scraper pan which blade is characterized by an efficient cutting action.

It is also an object of the present invention to provide such a scraper pan cutting blade which eliminates the need for a second piece of equipment for propelling the scraper.

A further object of the present invention is the provision of such a scraper pan cutting blade which is characterized by its ruggedness of construction and simplicity of operation.

SUMMARY OF THE INVENTION

The above and other objects of the invention which will become apparent hereinafter are achieved by the provision, on an earth mover scraper pan or the like, of a cutting blade assembly including a stationary blade mounted on the cutting edge of the scraper pan and having forwardly projecting, tapered teeth; a moveable blade mounted on the stationary blade for transverse reciprocating movement, the moveable blade also having forwardly projecting, tapered teeth which move across the teeth of the stationary blade; and power means for reciprocating the moveable blade.

For a more complete understanding of the invention and the objects and advantages thereof, reference should be had to the accompanying drawings and the following detailed description wherein a preferred embodiment of the invention is illustrated and described.

DESCRIPTION OF THE DRAWINGS

In the drawings:

FIG. 1 is a side elevational view of a scraper pan earth mover equipped with the blade assembly of the present invention;

FIG. 2 is a perspective view of the forward end of the scraper pan;

DESCRIPTION OF THE PREFERRED EMBODIMENT

Figure 3:
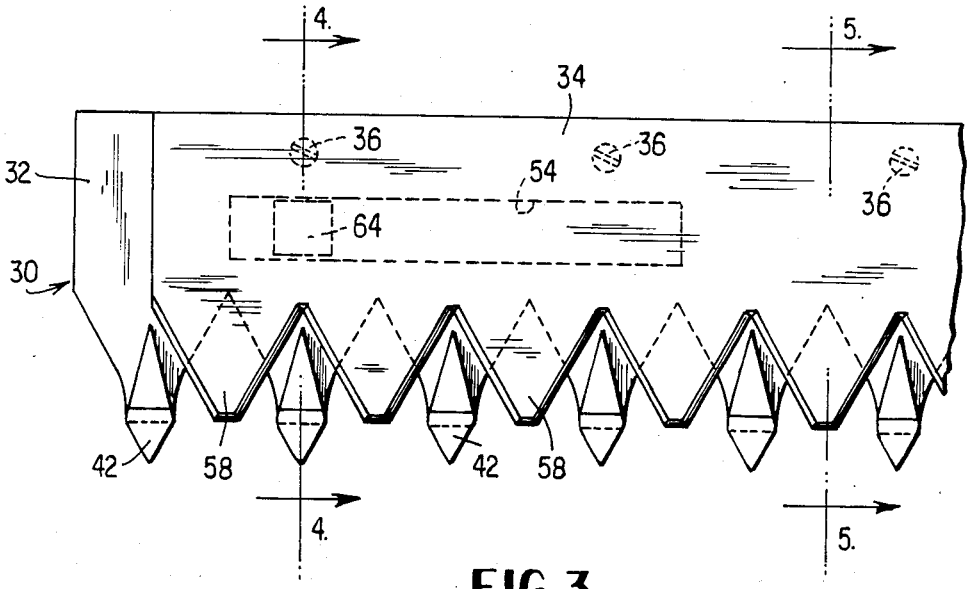
FIG. 3 is a fragmentary plan view of the forward end of the scraper pan and the blade assembly carried thereby.

A typical scraper pan type earth mover, designated generally by the reference numeral 10, is shown in FIG. 1 and includes a scraper pan 12 carried by a frame 14 which is pivotally connected at its forward end 16 to a tractor unit 18 and at its rear end to a propelling unit 20, suitable hydraulic cylinders 22 being provided for controlling the elevation of the pan. The scraper pan 12 includes a bottom wall 22, spaced side walls 24 and a rear wall 26, the forward or leading edge 28 of the bottom wall mounting the cutting blade assembly of the present invention, designated generally by the reference numeral 30.

Figure 4:
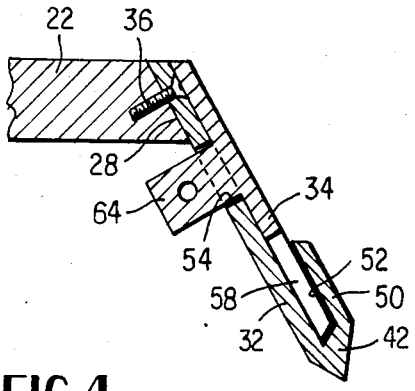
FIGS. 4 and 5 are fragmentary transverse cross sectional views taken on the lines 4—4 and 5—5, respectively, of FIG. 3.
Figure 5:
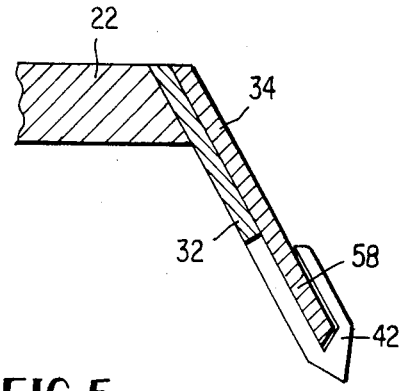
Figure 6:
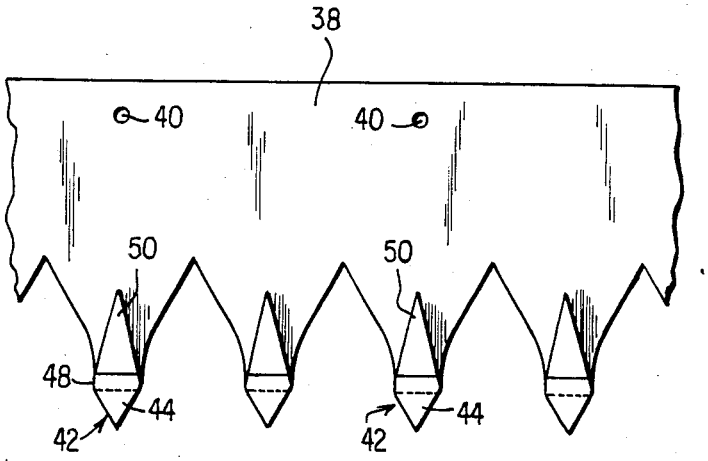
FIGS. 6 and 7 are fragmentary plan views of the stationary and moveable blades, respectively.
Figure 7:
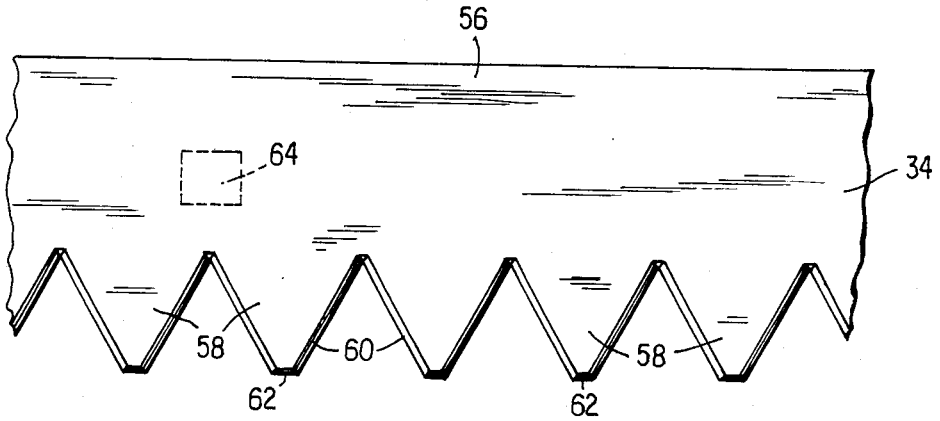

The blade assembly 30 consists of a fixed blade 32 and a cooperating moveable blade 34, the fixed blade being affixed to the pan bottom wall leading edge, for example, with bolts 36. The fixed or stationary blade includes a solid rear portion 38 extending the length thereof and provided with spaced holes 40 for reception of the mounting bolts 36. Projecting forwardly from the rear portion are cutting teeth 42, the cutting teeth being uniformly spaced along the length of the blade and tapering forwardly. As can be seen from FIG. 6, the forward portions 44 of the teeth widen outwardly as indicated at 48 and include, at the apexes thereof, upwardly and rearwardly projecting guards 50 which define, with the main top surface of the teeth, a rearwardly opening continual channel 52. Completing the description of the stationary blade, the rear portion 38 thereof is provided with two or more elongated openings 54 extending lengthwise. The moveable blade 34 includes a solid rear portion 56 and forwardly extending, uniformly spaced teeth 58, these teeth having bevelled edges 60 and truncated forward ends 62. Projecting rearwardly from the rear portion 56 are lugs 64 which, as can be seen from FIG. 4, project through the openings 54 of the stationary blade, one lug being provided for each opening. The moveable blade 34 is carried on the upper surface of the stationary blade with the forward ends of the teeth 58 being received in the channel 52, the widened portions 48 of the stationary teeth 42 serving to support the moveable teeth 58 as they move between adjacent stationary teeth.

Figure 8:
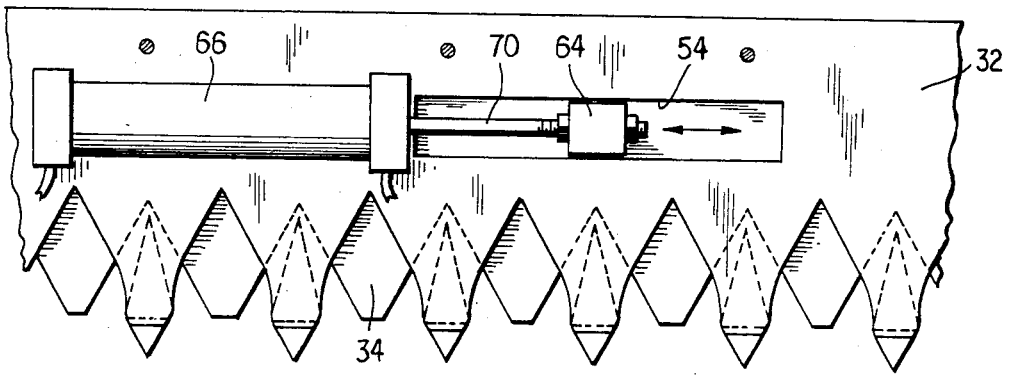
FIG. 8 is a bottom plan view of the forward end of the scraper pan, illustrating the blade drive mechanism.
Figure 9:
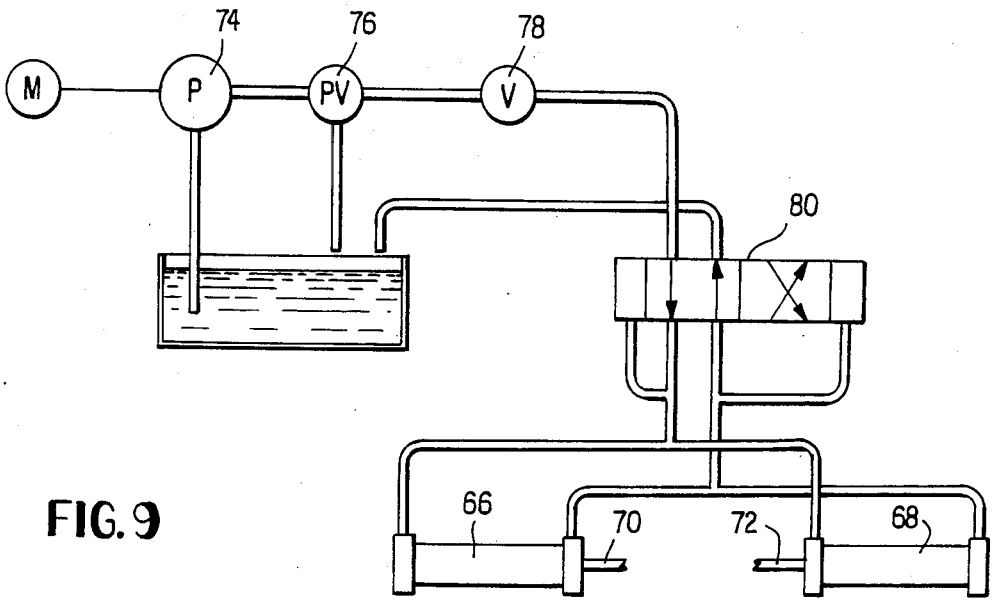
FIG. 9 is a schematic showing of the hydraulic power and control system of the drive mechanism.

One possible arrangement for imparting reciprocating motion to the moveable blade 34 is illustrated in FIGS. 8 and 9. Mounted on the rear surface of the stationary blade 32 in longitudinal alignment with the openings 54 are two double-acting hydraulic cylinders 66 and 68, the cylinders being arranged in opposition to one another. The piston rod 70, 72 of each cylinder is connected to the corresponding lug 64. Hydraulic fluid is supplied to the cylinders from a source such as pump 74 through a pressure relief valve 76, manually actuated control valve 78 and a reversing valve 80. The reversing valve 80 is, preferrably, of the pressure responsive type which automatically reverses when the fluid pressure on the supply side of the cylinders exceeds a preset limit. Such an arrangement provides automatic reciprocal movement of the blade 34 and serves to protect the blades in the event an obstruction is encountered by the moveable blade, the cylinders and blade automatically reversing at less than a full stroke in such an event.

In operation of the scraper pan earth mover equipped with the blade assembly of the present invention, substantial reductions in the required propelling power over that required for conventinal equipment are achieved. The tapered blade configuration results in a reduction in the initial penetrating force required and the cutting action of the recirpocating blade produces a further reduction.

It will be understood that, while a preferred embodiment of the invention has been illustrated and described herein, changes and additions may be made therein and thereto without departing from the spirit of the invention. Reference should, accordingly, be had to the appended claims in determining the true scope of the invention.

I claim:

1. In a scraper pan type earth mover, an improved cutting blade assembly, comprising:

a fixed blade mountable on the forward edge of said scraper pan, said fixed blade having uniformly spaced, forwardly projecting tapered cutting teeth and guard teeth, said guard teeth being located at the apexes of said cutting teeth, said cutting and guard teeth being spaced from one another to define therebetween a continual, transversely extending channel;

a moveable blade received within said channel and having forwardly projecting cutting teeth adapted to overly said cutting teeth of said fixed blade; and means for imparting reciprocating motion to said moveable blade.

2. The improved cutting blade assembly of claim 1 further including cooperating means on said fixed and moveable blades for restraining said moveable blade from forward movement relative to said fixed blade.

3. The improved cutting blade assembly of claim 1 wherein said means for imparting reciprocating motion includes at least one double acting hydraulic cylinder, means for connecting the piston rod of said cylinder to said moveable blade, a source of hydraulic fluid, and a reversing valve for connecting said source to said cylinder.

4. The improved cutting blade assembly of claim 3 wherein said reversing valve is a pressure response valve.

5. The improved cutting blade assembly of claim 1 wherein said cutting teeth of said fixed blade include widened portions adjacent the tips thereof, said widened portions providing support for said moveable blades.

* * * * *